United States Patent [19]

Moore et al.

[11] Patent Number: 4,984,606

[45] Date of Patent: Jan. 15, 1991

[54] TERRY FABRICS WITH TUCKS AND METHOD OF MAKING

[75] Inventors: W. Gerald Moore, Eden; Nancy W. Webster, Mebane, both of N.C.

[73] Assignee: Fieldcrest Cannon, Inc., Greensboro, N.C.

[21] Appl. No.: 405,348

[22] Filed: Sep. 11, 1989

[51] Int. Cl.[5] ..... D03D 39/22; D03D 27/08; B32B 3/02; D06C 23/04

[52] U.S. Cl. ..... 139/25; 139/396; 428/85; 428/95; 428/224; 428/229; 428/257; 26/18.5

[58] Field of Search ..... 139/434, 396, 25, 396, 139/25; 428/92, 85, 152

[56] References Cited

U.S. PATENT DOCUMENTS

| | | | |
|---|---|---|---|
| 745,112 | 11/1903 | Margerison | 139/396 |
| 793,524 | 7/1905 | Hewett . | |
| 1,511,753 | 10/1924 | Chisholm . | |
| 1,830,892 | 11/1931 | Talbirt | 139/396 |
| 1,846,751 | 2/1932 | Patterson | 139/396 |
| 1,930,769 | 2/1934 | Parker | 139/396 |
| 1,949,579 | 3/1934 | Parker | 139/25 |
| 1,998,041 | 4/1935 | Barbet . | |
| 2,121,162 | 6/1938 | Riley | 139/396 |
| 2,424,771 | 7/1947 | Preneta . | |
| 2,424,928 | 7/1947 | Glendinning et al. . | |
| 3,187,782 | 6/1965 | Gattoni | 139/396 |
| 4,726,400 | 2/1968 | Heiman | 139/396 |

*Primary Examiner*—George F. Lesmes
*Assistant Examiner*—James D. Withers
*Attorney, Agent, or Firm*—Bell, Seltzer, Park and Gibson

[57] ABSTRACT

A woven terry fabric having tucks formed therein for obtaining novel aesthetic effects in the fabric and the method of weaving such fabrics.

19 Claims, 5 Drawing Sheets

TERRY FABRICS WITH TUCKS AND METHOD OF MAKING

FIELD OF THE INVENTION

This invention relates to terry fabrics and more particularly towels formed from terry fabric.

In the past, terry fabrics have been formed with a variety of aesthetic effects created through one or more of the following: patterning, variable height pile areas, various sheared and non-sheared pile areas, etc.

Terry fabrics of the instant invention present novel aesthetic effects by including tuck areas combined with terry pile areas in various selected areas of the fabric. The formation of flat non-terry fabrics with tuck areas therein is old as evidenced by U.S. Pat. Nos. 793,524, 1,511,753, 1,998,041, 2,231,388, 2,424,771, and 2,424,928. However, no one heretofore has recognized the novel aesthetic terry fabric effects to be obtained by the incorporation of tucks in terry fabrics as in this invention.

Accordingly it is the primary object of this invention to provide terry fabrics with novel aesthetic effects by the incorporation of tucks in selected areas of the terry fabric and the method of making the same.

It is a more specific object of this invention to provide terry towels with novel aesthetic effects by the incorporation therein of tucks in border or end areas of the towel, and the method of making the same.

BRIEF DESCRIPTION OF THE DRAWINGS

Some of the features of the invention having been stated, others will appear as the description proceeds when taken in connection with the accompanying drawings, in which.

DETAILED DESCRIPTION OF THE PREFERRED EMBODIMENTS

Figure 1:
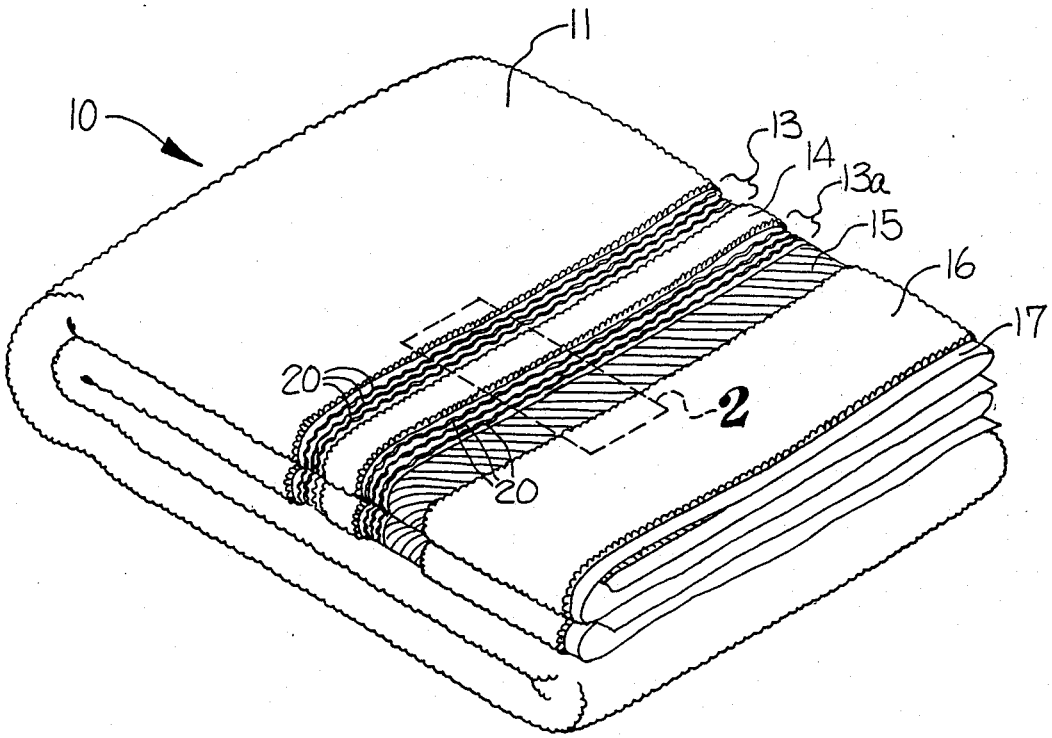
FIG. 1 is an isometric view of a terry towel representing one embodiment of a typical terry fabric produced in accordance with this invention.

Referring more specifically to the drawings, one form of a terry towel embodying a woven terry fabric produced in accordance with this invention is shown broadly designated at 10 in FIGS. 1, 2, 3, 5 and 12. In this embodiment, it will be observed in FIGS. 1 and 2 that opposite faces of the body or major area 11 of the towel 10 are defined by terry pile, and each of the opposite end portions of each side of the towel is provided with a series of design areas 13, 14, **13*a*, 15, 16 and a hem 17. The design areas which appear on the upper face of the fabric in FIGS. 1, 2, 3, 5 and 12 may be the same at each end of the towel and include a pair of spaced apart tuck areas 13, 13*a*, an intervening terry pile area 14, a non-terry border area 15 and a terry pile border area 16**.

Figure 2:
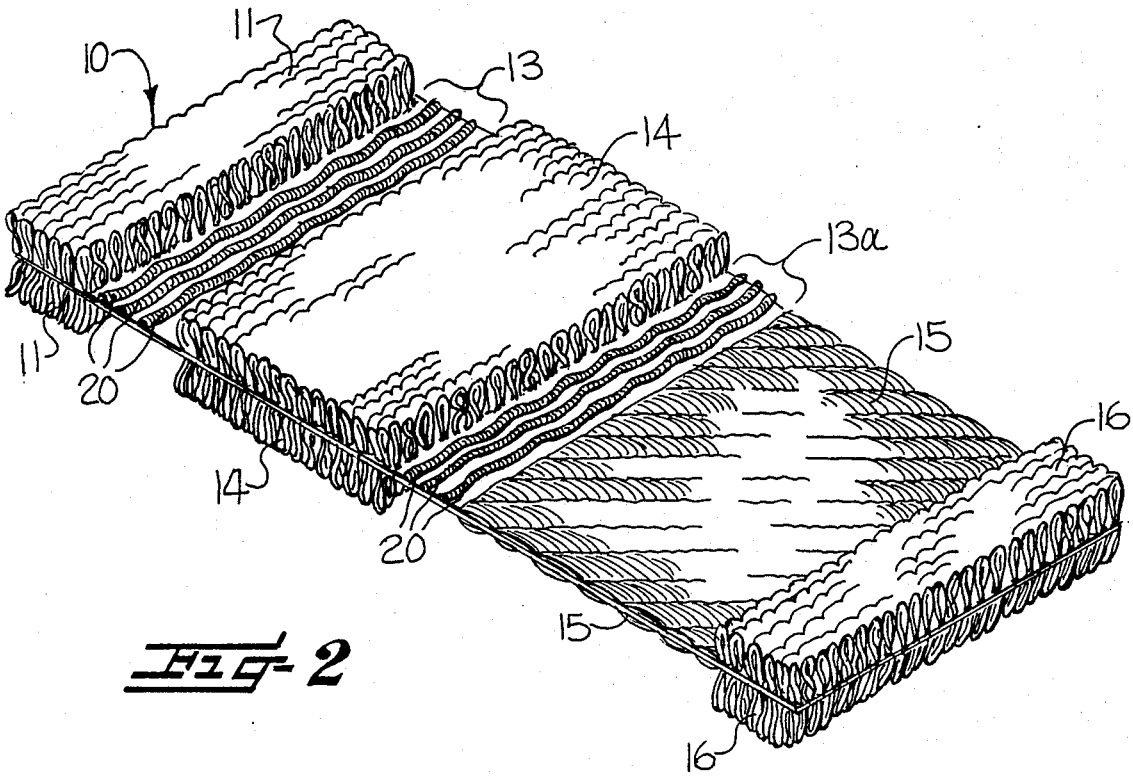
FIG. 2 is an enlarged fragmentary detailed view of the area 2 enclosed in broken lines in FIG. 1.
Figure 3:
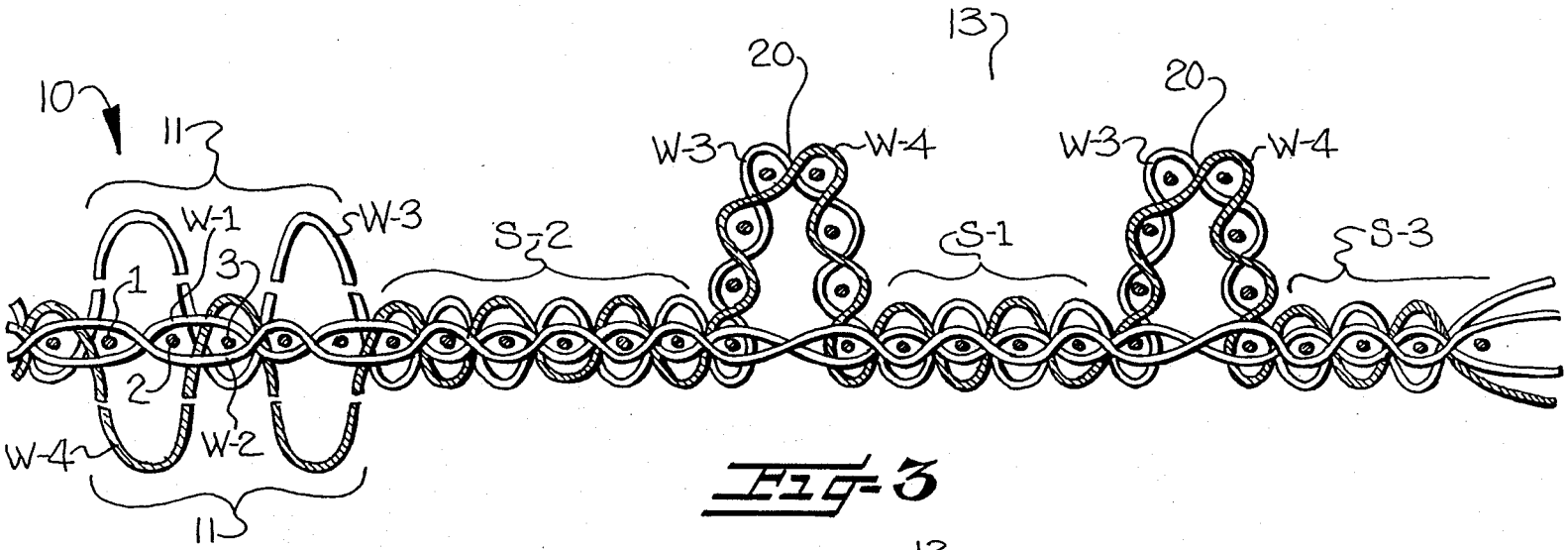
FIG. 3 is a greatly enlarged fragmentary sectional view taken warpwise of a typical terry fabric woven in accordance with this invention as shown in FIGS. 1 and 2, but illustrating only two adjacent tucks extending from one face of the fabric.

In this instance, the areas of the underside or lower face of the fabric 10 and directly opposite from the tucks 20 shown in the upper face areas 13, **13*a* of FIGS. 2, 3, 5 and 12 are devoid of any tucks. In this regard, referring now to FIG. 3, this greatly enlarged warpwise sectional view has one of the tucks omitted from the woven terry fabric 10. In other words the fabric of the towel 10 in FIG. 3 is only provided with two tucks 20 as opposed to the three tucks shown in each of the upper face tuck areas 13, 13*a* in FIGS. 1 and 2**.

Only a portion of the major area of the fabric 10 of FIG. 3 is shown and designated at 11 in FIG. 3. As shown, the area 11 (FIG. 3) is a typically woven terry pile area as is the case with respect to the major area 11 and the terry border area 16 of FIGS. 1 and 2. Accordingly, the more detailed description to follow will be given with particular reference to the fabric 10 of FIG. 3.

As shown in the left-hand portion of FIG. 3, the woven terry fabric 10 is formed in a well-known three-pick terry weave of filling yarns 1, 2, 3 interwoven with ground warp yarns W–1, W–2 and terry warp yarns W–3, W–4 throughout major areas of the fabric. Each terry weave cycle may include a greater number of filling yarns, if desired. Thus, major areas (11 Of FIGS. 1, 2, 3, 5 and 12) are formed as a ground fabric with the terry warp yarns extending therefrom in the form of terry pile and with the terry pile defining opposite faces of the fabric. The terry pile is shown in FIGS. 2 and 3 in the form of terry loops.

Although the terry loops in the left-hand portion of FIG. 3 are shown extending from the ground fabric to a lesser extent than the tucks 20, such difference in the height of the terry loops relative to the height of the tucks 20 is for the purposes of illustration only, since it is apparent that the terry loops of the actual fabric will extend a substantially greater distance from the ground fabric than the tucks 20 and, with this in mind, it is apparent that the terrY loops may be sheared by means of conventional shearing equipment, if desired, without shearing the tucks 20 so that the terry pile in the areas 11, 14 and 16 may be sheared on both sides of the fabric to form cut terry pile thereof.

In order that the tucks 20 of the woven terry fabric 10 are clearly defined and thereby of enhanced aesthetic appearance, adjacent tucks in each group or tuck area are closely spaced, but separated by a relatively narrow strip of non-terry fabric S-1 of a few picks of filling, e.g., four picks in FIG. 3, and similar narrow strips of non-terry fabric S-2, S-3 connect the outer or distal sides of the tucks to other areas of the fabric. In this regard, it will be noted in FIG. 3 that the non-terry area S-2 is shown as including about six picks of filling interwoven with the ground warp yarns and the terry warp yarns and extending between one of the tucks 20 and the adjacent terry pile area 11. The non-terry area S-3 extends from one side of the right-hand tuck 20 in FIG. 3 and may connect the latter tuck to an area, not shown, of any suitable form, such as the twill weave area illustrated at 15 in FIGS. 1 and 2. Each of the tucks 20 has the terry warp yarns W-3, W-4 woven with filling yarns 1, 2, 3 independently of the ground warp yarns W-1, W-2. To this end, in accordance with the method of this invention, by referring to FIG. 3 it can be appreciated that the major area 11 of the fabric there shown is formed, at times, by interweaving the filling yarns 1, 2, 3 with the ground warp and terry warp yarns W-1, W-2; W-3, W-4 to form the ground fabric with the terry Warp yarns W-3, W-4 forming a terry pile thereon, and at other times, each of the tucks 20 is formed by discontinuing the weaving of the ground warp yarns W-1, W-2 with the ground warp yarns being positioned on a common side of the warp shed formed by the terry warp yarns, and weaving the terry warp yarns W-3, W-4 for a predetermined number of picks of filling to form predetermined spaced apart tucks 20 extending widthwise of the fabric.

It will be noted that each tuck 20 in FIG. 3 is formed by weaving several picks of filling yarns with the terry warp yarns W-3, W-4 only, there being six picks of filling yarns shown in each tuck 20 by Way of example in this instance. However, each 20 tuck may include a greater or lesser number of filling yarns if desired. In fact, some of the tucks in a woven terry fabric produced according to this invention, may be of a different size than other tucks by including a lesser or greater number of filling yarns in some of the tucks than the number of filling yarns present in other tucks. Also, the filling yarns in at least some of the tucks may be of a color or characteristic contrasting with the color or characteristic of the filling yarns in others of the tucks and/or in the terry pile areas. It is contemplated that the filling yarns in the tucks 20 may be of lesser shrinkability than the filling yarns in other areas of the fabric. For example, all of the filling yarns except those in the tucks 20 may be of cotton or other cellulosic yarn and the filling yarns in the tucks may be of polyester or other synthetic yarns all within the concept of this invention.

Figure 4:
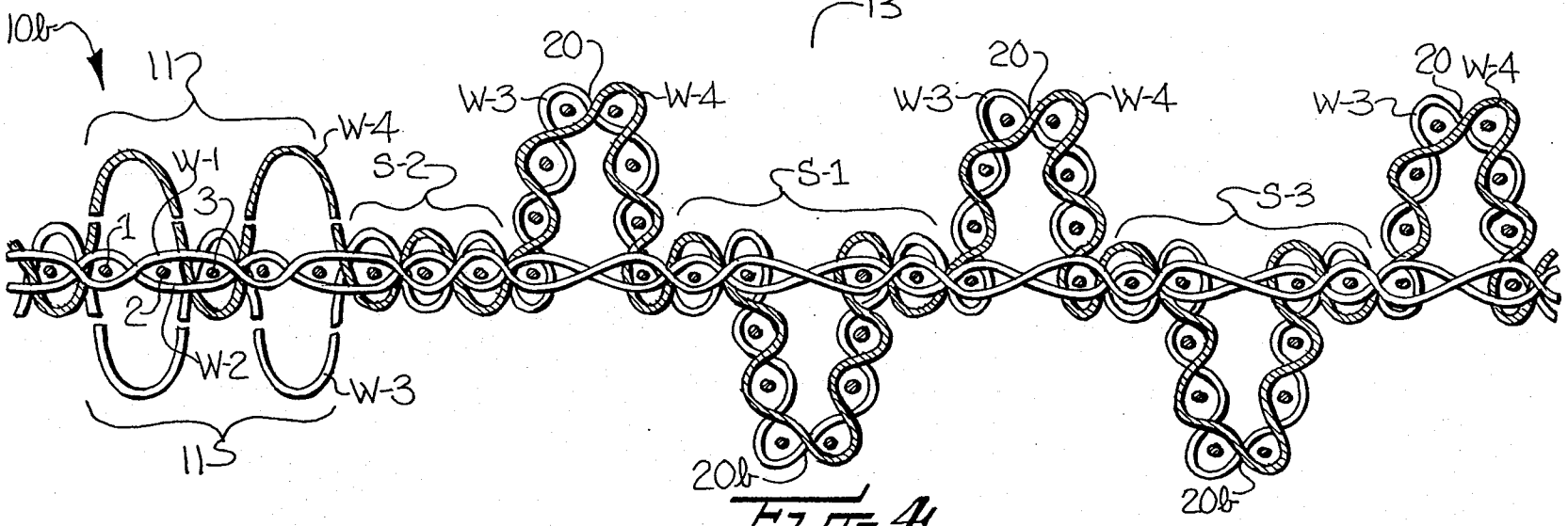
FIG. 4 is a view similar to FIG. 3, but showing a second embodiment in which typical tucks extend outwardly from both faces of the woven terry fabric according to this invention.

The woven terry fabric shown in FIG. 4 is broadly designated at 10*b* and is quite similar to the fabric 10 of FIG. 3. Accordingly, those parts of the fabric 10*b* which are similar to the fabric 10 of FIG. 3 will bear the same reference characters in order to avoid repetitive description. It will be noted that the fabric 10*b* differs essentially from fabric 10 in that tucks 20*b* are extending outwardly from the lower face of the fabric 10*b* and are in staggered relation to the tucks 20 extending outwardly from the upper face of the terry fabric 10*b*. Also, in FIG. 4, the fabric 10*b* includes three of the closely spaced tucks 20 extending upwardly or outwardly from the upper face of the fabric 10*b*, and the fabric includes two closely spaced tucks 20*b* extending outwardly from the lower face of the fabric 10*b* in FIG. 4. In other respects, the fabric 10*b* of FIG. 4 may be constructed substantially in the same manner as fabric 10 as shown in FIG. 3. Accordingly, a further detailed description of the fabric 10*b* of FIG. 4 is deemed unnecessary.

Referring now to FIGS. 6-11, all of these views show woven terry fabrics having various combinations of design areas which are substantially the same as those described heretofore with respect to the first and second embodiments 10, 10*b* of the invention. Therefore, although the design areas are arranged differently in FIGS. 6-11 than they are in FIGS. 1 and 2, the individual design areas will bear the same reference characters as are used in FIGS. 1-5 and 12 so as to aid in realizing the wide variety of woven terry fabric designs possible according to the present invention.

Figure 5:
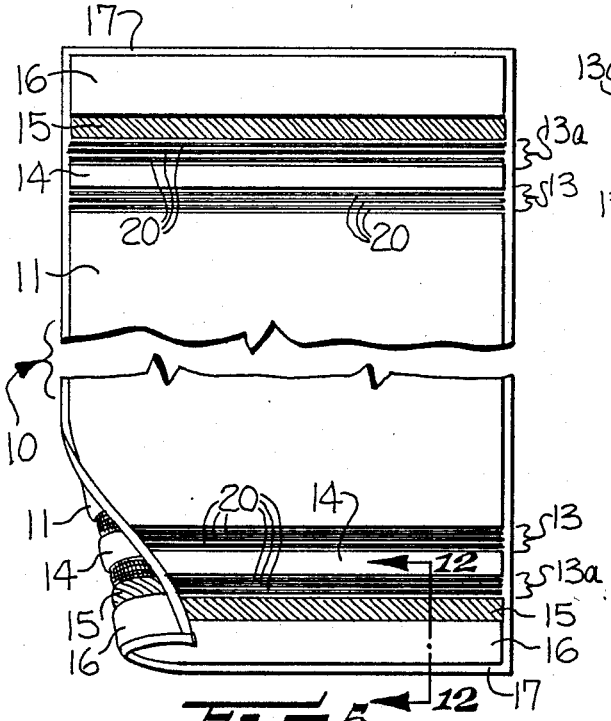
FIG. 5 is an elevational view of the woven terry fabric shown in FIGS. 1, 2 and 3.
Figure 6:
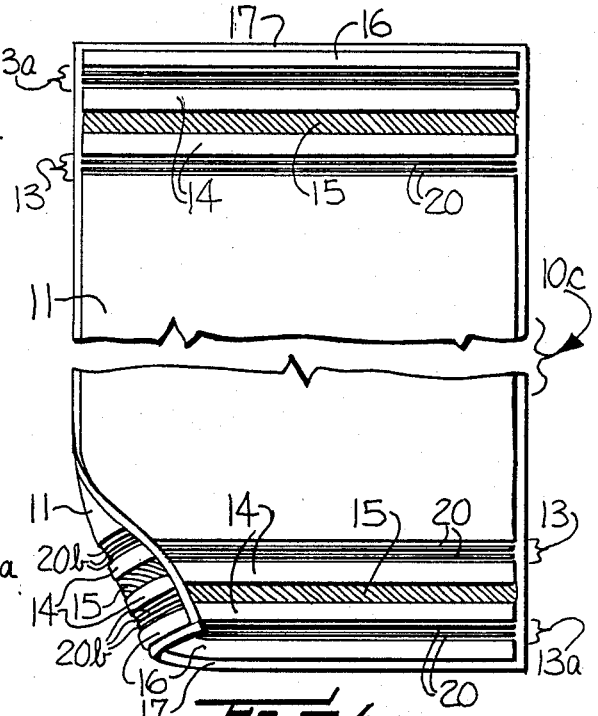
FIGS. 6–11 are elevational views of different towels illustrating various aesthetic designs produced in accordance with this invention.
Figure 7:
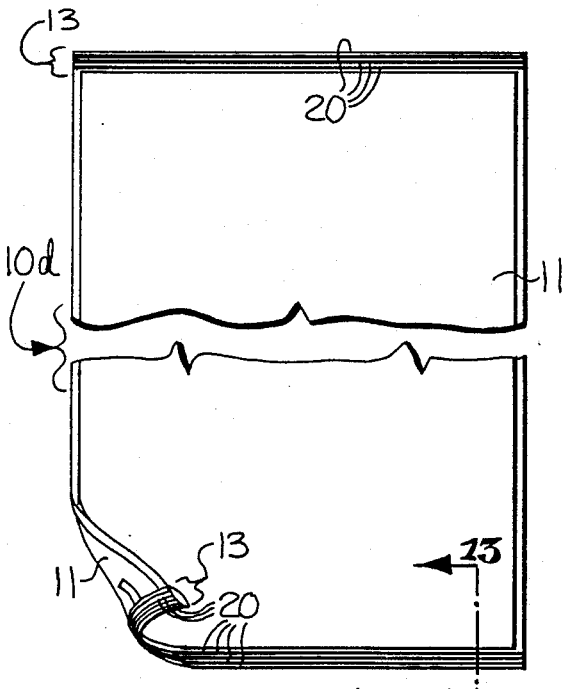
Figure 13:
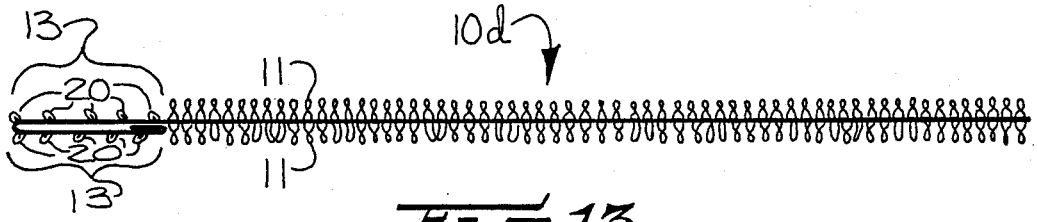

By comparing the numerically designated design areas 11, 13, 13*a*, 14, 15, 16, 17 in FIG. 6 with the same numbered areas in FIG. 5, it can be seen that the arrangement of the design areas of the towel 10*c* is quite clear in FIG. 6. In FIG. 7, however, only a narrow tuck area 13 is provided at each end of each face of the towel 10*d* (FIGS. 7 and 13) With an intervening major area 11 therebetween. It will be observed in FIG. 13 that the end area 13 of towel 10*d* there shown is folded upon itself and suitably secured in this position as by a suitable adhesive, or by sewing. It will be noted that, as woven, tucks 20 appear on only one face of the woven terry towel 10*d* in FIG. 13, but the major area 11 of the fabric 10 *d* is provided with terry pile throughout each face of the fabric. This facilitates forming a hem of the tuck areas 13 at each end of towel 10*d*.

Figure 8:
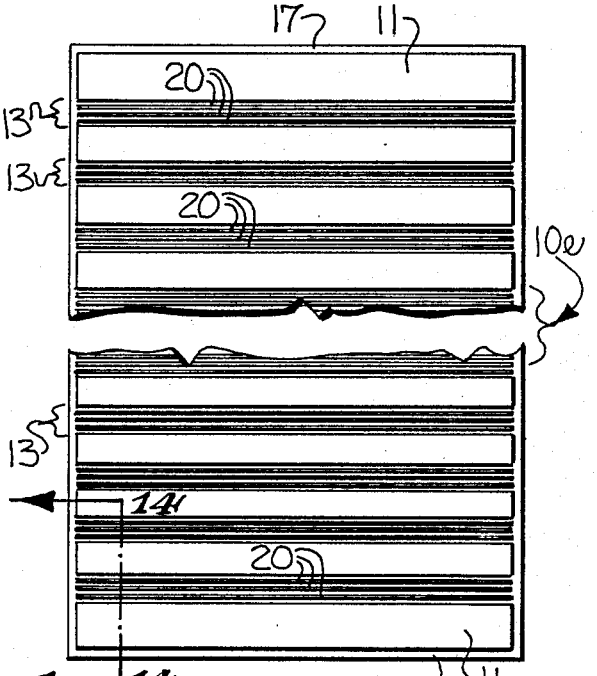
Figure 14:
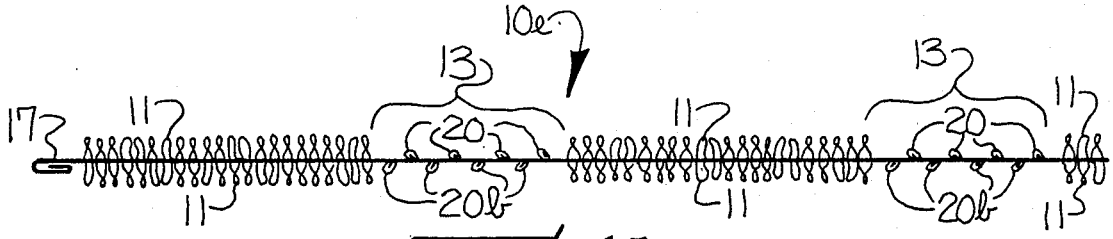

Referring to FIGS. 8 and 14, it will be observed that the terry towel 10*e* there shown includes a plurality of relatively closely spaced tuck ar®as 13 which extend widthwise of both faces of the fabric and are separated by terry pile areas 11 which, collectively, define major areas of the fabric along both faces thereof (FIG. 14).

Figure 9:
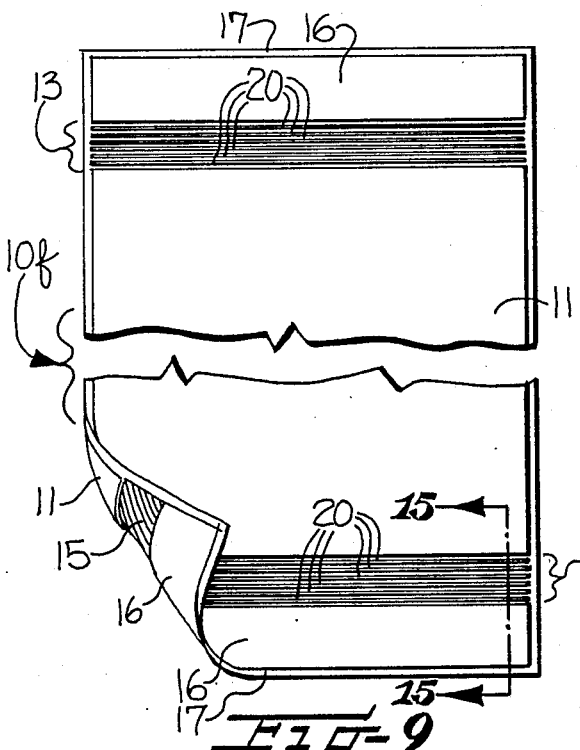
Figure 15:
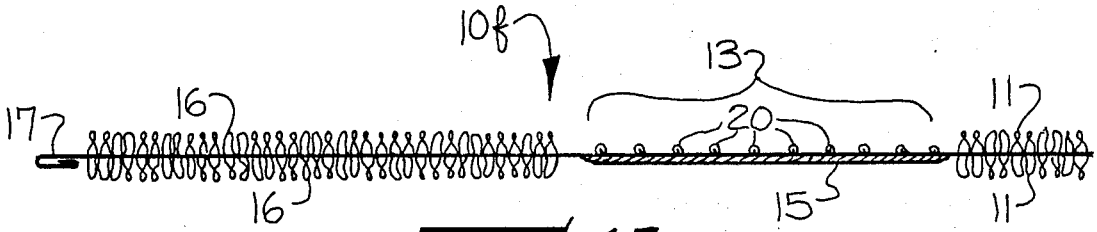

Referring to FIGS. 9 and 15, the woven terry towel 10*f* there shoWn includes design areas 13, 16 at each end thereof Which may be constructed in the same manner as that heretofore described with respect to the design areas 13, 16 of the towel 10 in FIGS. 1 and 2. Both faces of towel 10*f* are provided with terry pile ares 11, 16, but they are separated by a twill woven area 15 on the lower face of the fabric and opposite from tuck area 13. The design tuck area 13 at each end of the woven terry towel 10*f* in FIG. 9 differs from the tuck area 13 of the towel 11 in FIGS. 1, 3, 5 and 12 only in that it has a greater number of tucks 20 in such tuck area. Accordingly, a further description thereof is deemed unnecessary.

Figure 10:
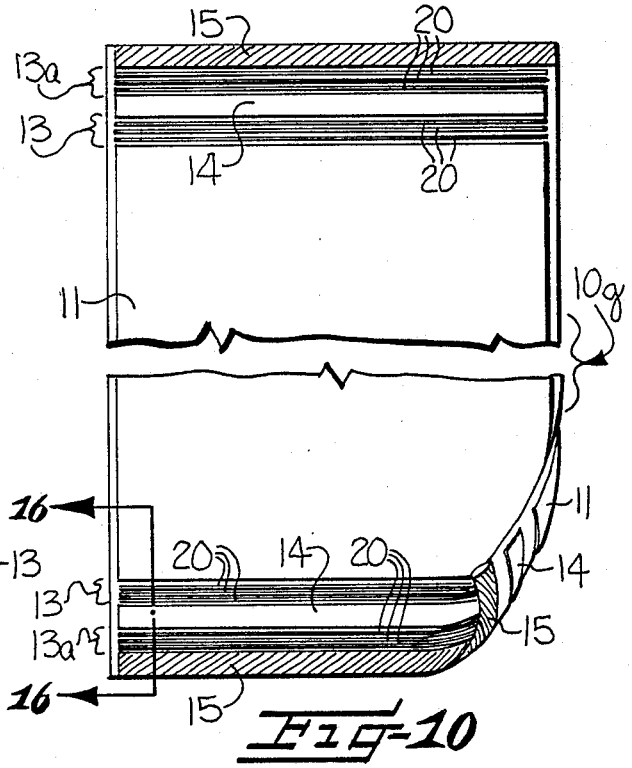
Figure 16:
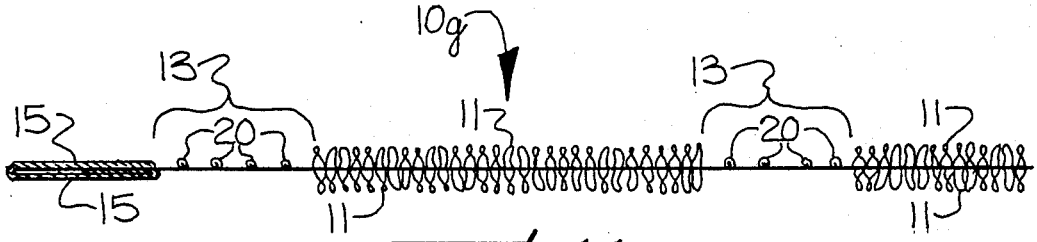

The woven terry towel 10*g* in FIGS. 10 and 16 is provided with a bodY or major area 11 of terry warp yarns extending from the ground fabric in the form of terry pile defining opposite faces of the fabric. Each end of the towel 10*g* is provided with a series of design areas 13, 14, 13*a*, 15 arranged in that order. The latter areas 13, 14, 13*a*, 15 are constructed in substantiallY the same manner as the areas 13, 13*a*, 14, 15 of the first embodiment of the towel 10 shown in FIGS. 1 and 2, although the area 15 is of the twill woven type and is shown in FIG. 16 as being folded up on itself and stitched together to form a hem at the corresponding end of the towel 10*g*. A further more detailed description of the towel 10*g* shown in FIGS. 10 and 16 is deemed unnecessary.

Figure 11:
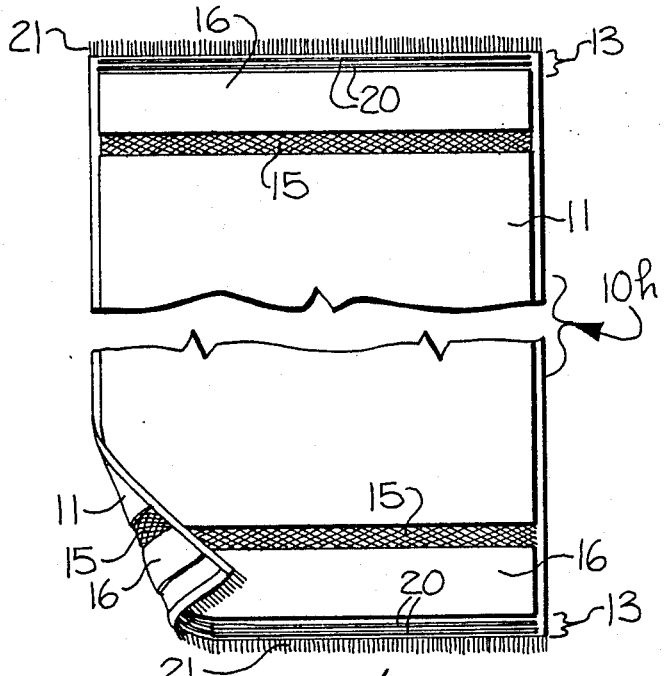
Figure 12:
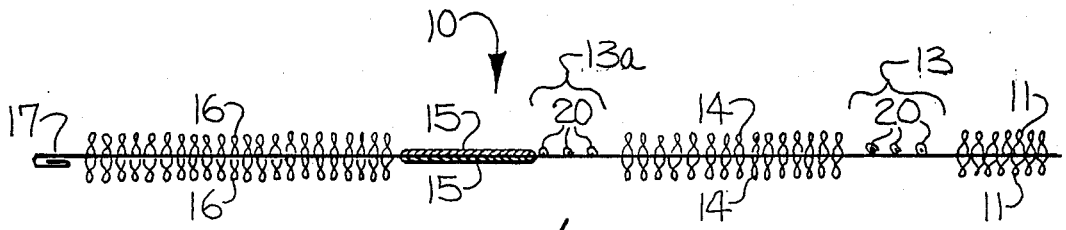
FIGS. 12–16 are schematic, fragmentary enlarged warpwise sectional views taken substantially along the respective lines 12—12, 13—13, 14—14, 15—15 and 16—16 in the respective FIGS. 5, 7, 8, 9, and 10.

The terry towel 10*h* shown in FIG. 11 includes areas 11, 15, 16, 13 which are arranged in that order at each end of the terry towel 10*h*. Since the areas 11, 13, 15, 16 may be formed in essentially the same manner as that described with respect to the areas 11, 13, 15, 16 in FIGS. 1 and 2, a further more detailed description of the terry towel 10*h* in FIG. 11 us deemed unnecessary. It should be noted however, that the distal warpwise opposed ends of the towel in 10*h* in FIG. 11 are provided with respective fringes 21 thereon formed of the ground warp yarns and the terry warp yarns extending outwardly from the endmost design areas 13, which are, of course, tuck areas. In this regard, each of the tuck areas 13 of the terry towel 10*h* in FIG. 11 includes two tucks 20 therein. It is apparent that each of the tuck areas 20 may include but a single tuck 20 or it may include several additional tucks, as desired.

From the foregoing description, it can be seen that we have provided several embodiments of terry fabrics and a method of making the same wherein the terry fabrics are formed of filling yarns, ground warp yarns, and terry warp yarns which, at times, are interwoven to form ground fabric with the terry warp yarns forming a terry pile thereon, and at other times the weaving of the ground warp yarns is discontinued, and weaving of the terry warp yarns with respective filling yarns is continued for a predetermined number of picks of filling at predetermined spaced apart fabric areas to form tucks extending widthwise of the fabric. In order to accommodate the formation of the tucks, regardless of whether the tucks are being formed on the upper or lower faces of the woven terry fabric, or both, not only is the weaving of the ground warp yarns discontinued, but the ground warp yarns are positioned on a common side of the warp shed formed by the terry warp yarns during the weaving of each of the tucks. Stated otherwise, the weaving of the ground warp yarns is discontinued by positioning all of the ground warp yarns on one side of the warp shed formed by the terry warp yarns during the weaving of certain of the tucks, and at other times all of the ground warp yarns are positioned on the opposite side of the warp shed during the weaving of certain other of the tucks so that the terry fabric may be woven with tucks extending along opposite faces of the fabric as shown in FIG. 4.

When the tucks 20 and/or **20*b* (FIGS. 3 and 4) are formed of relatively high shrink cellulosic filling yarns of material essentially the same as the filling yarns used in forming the terry pile areas, as is desirable in some instances, the tucks are of a relatively uniform nature. On the other hand, when the filling yarns in the tucks 20 and/or 20*b*** are formed of preshrunk filling yarns or yarns of relatively low shrink synthetic filling yarns, such as polyester yarns, the resultant tucks take the form of a rippled or wavy effect due to the differential in shrinkage of the hydrophobic polyester filling yarns in the tuck areas as compared to the shrinkage of the hydrophilic filling yarns in the body of the fabric.

In the drawings and specification there have been set forth preferred embodiments of the invention, and although specific terms are employed, they are used in a generic and description sense only and are not for the purposes of limitation, the scope of the invention being defined in the claims.

That which is claimed is:

1. A woven terry fabric comprising filling yarns, ground warp yarns, and terry warp yarns interwoven with each other throughout a major area of the fabric and forming ground fabric with said terry warp yarns extending therefrom in the form of terry pile and with the terry pile defining at least one face of the fabric, and other areas of the fabric having said terry warp yarns interwoven with filling yarns independently of said ground warp yarns and forming tucks extending widthwise of the fabric.

2. A woven terry fabric comprising filling yarns, ground warp yarns, and terry warp yarns interwoven with each other throughout a major area of the fabric and forming ground fabric with said terry warp yarns extending therefrom in the form of terry pile and with the terry pile defining opposite faces of the fabric, other areas of the fabric having said filling yarns, ground warp yarns and terry warp yarns interwoven with each other to form non-terry border areas on both sides of the fabric, and further areas of the fabric having said terry warp yarns interwoven with filling yarns independently of said ground warp yarns and forming tucks extending widthwise of the fabric and along opposite faces of the fabric whereby the woven terry fabric has terry pile, tucks, and non-terry areas along both sides of the fabric.

3. A woven terry fabric according to claim 1 or 2 wherein said tucks are in the form of groups of tucks, and each group comprises a plurality of closely spaced tucks.

4. A woven terry fabric according to claim 1 or 2 wherein some of said tucks are of a different size than other tucks.

5. A woven terry fabric according to claim 1 or 2 wherein the filling yarns in at least some of said tucks are of a color contrasting with the color of the filling yarns in the terry pile areas.

6. A woven terry fabric according to claim 1 or 2 wherein the filling yarns in at least some of said tucks are of low shrinkable as compared with the shrinkability of the filling yarns in the terry pile areas.

7. A woven terry towel comprising filling yarns, ground warp yarns, and terry warp yarns interwoven with each other throughout major areas of the towel and forming ground fabric with said terry warp yarns extending therefrom in the form of terry pile and with the terry pile defining opposite faces of the towel, and other areas of the towel having said terry warp yarns interwoven with filling yarns independently of said ground warp yarns and forming tucks extending widthwise of the towel along at least one face thereof.

8. A woven terry towel comprising filling yarns, ground warp yarns, and terry warp yarns interwoven with each other throughout major areas of the towel and forming ground fabric with said terry warp yarns extending therefrom in the form of terry pile and with the terry pile defining opposite faces of the towel, other areas of the towel having said filling yarns, ground warp yarns and terry warp yarns interwoven with each other to form non-terry border areas on both sides of the towel adjacent opposite ends of the towel, and further areas of the towel having said terry warp yarns interwoven with filling yarns independently of said ground warp yarns and forming tucks extending widthwise of the towel and on opposite sides of the towel whereby the woven terry towel has terry pile, tucks, and non-terry areas along both sides of the towel.

9. A woven terry towel according to claim 7 or 8 wherein a plurality of said tucks are provided along each face of the towel.

10. A woven terry towel according to claim 7 or 8 wherein said tucks are arranged in groups in predetermined areas of the towel and wherein each group of tucks comprises a plurality of closely spaced tucks.

11. A woven terry fabric according to claim 7 or 8 wherein the filling yarns in at least some of said tucks are of a characteristic differing from that of the filling yarns in the terry pile areas.

12. A woven terry fabric according to claim 7 or 8 wherein the filling yarns in at least some of said tucks are of a color contrasting with the color of the filling yarns in other tucks.

13. A method of weaving a terry fabric having filling yarns, ground warp yarns, and terry warp yarns comprising at times interweaving the filling yarns with the ground warp and terry warp yarns to form ground fabric with the terry warp yarns forming a terry pile thereon, and at other times discontinuing the weaving of the ground warp yarns and weaving the terry warp yarns for a predetermined number of picks of filling and at predetermined spaced apart fabric areas to form tucks extending widthwise of the fabric.

14. A method of weaving a terry fabric according to claim 13 wherein the step of discontinuing the weaving of the ground warp yarns comprises positioning the ground warp yarns on a common side of the warp shed formed by the terry warp yarns during the weaving of each of said tucks.

15. A method of weaving a terry fabric according to claim 13 wherein the step of discontinuing the weaving of the ground warp yarns comprises positioning all the ground warp yarns on one side of the warp shed formed by the terry warp yarns during the weaving of certain of said tucks, and at other times positioning all the ground warp yarns on the opposite side of the warp shed during the weaving of certain other of said tucks whereby the terry fabric is woven with tucks extending along opposite faces of the fabric.

16. A method of weaving a terry fabric according to claim 13 wherein filling yarns of a characteristic differing from that of the filling yarns in the terry pile areas are inserted during the weaving of the tucks.

17. A method of making a terry fabric which comprises at times interweaving relatively high shrinkable filling yarns with ground warp yarns and terry warp yarns to form ground fabric with the terry warp yarns forming a terry pile on the ground fabric, and at other times interweaving the terry warp yarns with a plurality of successive picks of relatively low shrinkable filling yarns independently of the ground warp yarns and at predetermined spaced apart areas to form tucks extending widthwise of the fabric, and subjecting the thus woven fabric to a heated liquid finishing operation whereby the consequent differential shrinkage occurring between the high and low shrinkage filling yarns causes the tucks to have imparted thereto a rippled wavy effect.

18. A method of making a terry fabric according to claim 17 wherein said relatively high shrinkable filling yarns and terry warp yarns are hydrophilic yarns, and wherein said relatively low shrinkable filling yarns are hydrophobic yarns.

19. A method of making a terry fabric according to claim 17 wherein said relatively high shrinkable filling yarns and terry warp yarns are cotton yarns, and wherein said relatively low shrinkable filling yarns are polyester yarns.

* * * * *